US008052444B1

(12) United States Patent
McMahon et al.

(10) Patent No.: US 8,052,444 B1
(45) Date of Patent: Nov. 8, 2011

(54) LATCHING RELEASE SYSTEM FOR A CONNECTOR ASSEMBLY

(75) Inventors: Roy P. McMahon, Indianapolis, IN (US); Sarah E. Graber, Carmel, IN (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/874,831

(22) Filed: Sep. 2, 2010

Related U.S. Application Data

(60) Provisional application No. 61/239,312, filed on Sep. 2, 2009.

(51) Int. Cl.
*H01R 13/73* (2006.01)

(52) U.S. Cl. ..... 439/258

(58) Field of Classification Search ..... 439/258, 439/362, 254, 253
See application file for complete search history.

(56) References Cited

U.S. PATENT DOCUMENTS

| | | | | |
|---|---|---|---|---|
| 3,496,519 | A * | 2/1970 | Vetter | 439/258 |
| 4,138,181 | A * | 2/1979 | Hacker et al. | 439/258 |
| 4,279,458 | A * | 7/1981 | Knapp | 439/255 |
| 5,080,600 | A * | 1/1992 | Baker et al. | 439/258 |

* cited by examiner

*Primary Examiner* — Phuong Dinh
(74) *Attorney, Agent, or Firm* — Baker Botts L.L.P.

(57) ABSTRACT

In certain embodiments, a connection system includes a secondary latching release mechanism coupled to a lanyard release connector and a lanyard. The lanyard release connector has a primary latching release mechanism adapted to hold a complementary connector of a payload. The secondary latching release mechanism includes a mechanical forcing device that applies a force for actuating a primary latching release mechanism of the latching release connector when the mechanical forcing device is actuated by the lanyard such that the payload may be jettisoned from a vehicle.

20 Claims, 6 Drawing Sheets

LATCHING RELEASE SYSTEM FOR A CONNECTOR ASSEMBLY

RELATED APPLICATIONS

This application claims the benefit under 35 U.S.C. §119 (e) of the priority of U.S. Provisional Patent Application Ser. No. 61/239,312, entitled "Latching Release System for a Connector Assembly," filed Sep. 2, 2009, the entire disclosure of which is hereby incorporated by reference.

TECHNICAL FIELD OF THE DISCLOSURE

This disclosure generally relates to connectors, and more particularly, to a latching release system for a connector assembly.

BACKGROUND

Modern military aircraft are typically configured with payloads, such as bombs or missiles for armament. These payloads may be used by the aircraft to disable or incapacitate known threats in a theater of battle. In many cases, payloads may be configured within or underneath the fuselage or wings of the aircraft and ejected or jettisoned at a precise moment to strike their intended target. Smart bombs are a particular type of military store that include processing circuits for guidance and/or triggering.

SUMMARY

In certain embodiments, a connection system includes a secondary latching release mechanism coupled to a lanyard release connector and a lanyard. The lanyard release connector has a primary latching release mechanism adapted to hold a complementary connector of a payload. The secondary latching release mechanism includes a mechanical forcing device that applies a force for actuating a primary latching release mechanism of the latching release connector when the mechanical forcing device is actuated by the lanyard such that the payload may be jettisoned from a vehicle.

Certain embodiments of the present disclosure may provide one or more technical advantages. For example, certain embodiments of the connection system may provide improved separation of the lanyard release connector from its complementary connector during ejection of a payload to which it may be connected. The timing of the ejection of payloads may be important to the accuracy of their trajectory during descent. Thus, the secondary latching release mechanism of certain embodiments of the present disclosure may provide an additional mechanical force to help ensure that lanyard release connector is released in a timely and consistent manner. For example, the additional mechanical force provided by certain embodiments of the present disclosure may help overcome problems introduced by binding between the lanyard release connector and its complementary connector that may occur during release of the lanyard release connector, which may help ensure that the store ejects properly from the aircraft or other entity.

In a particular example, certain embodiments of the secondary latching release mechanism direct a force upon lanyard release connector in a relatively even manner along the axis of the lanyard release connector to ensure that the lanyard release connector does not bind with its complementary connector during separation.

Certain embodiments of the present disclosure may provide some, all, or none of these advantages. Certain embodiments may provide one or more other technical advantages, one or more of which may be readily apparent to those skilled in the art from the figures, descriptions, and claims included herein.

BRIEF DESCRIPTION OF THE DRAWINGS

To provide a more complete understanding of embodiments of the present disclosure and the features and advantages thereof, reference is made to the following description taken in conjunction with the accompanying drawings, in which.

DESCRIPTION OF EXAMPLE EMBODIMENTS

Figure 1:
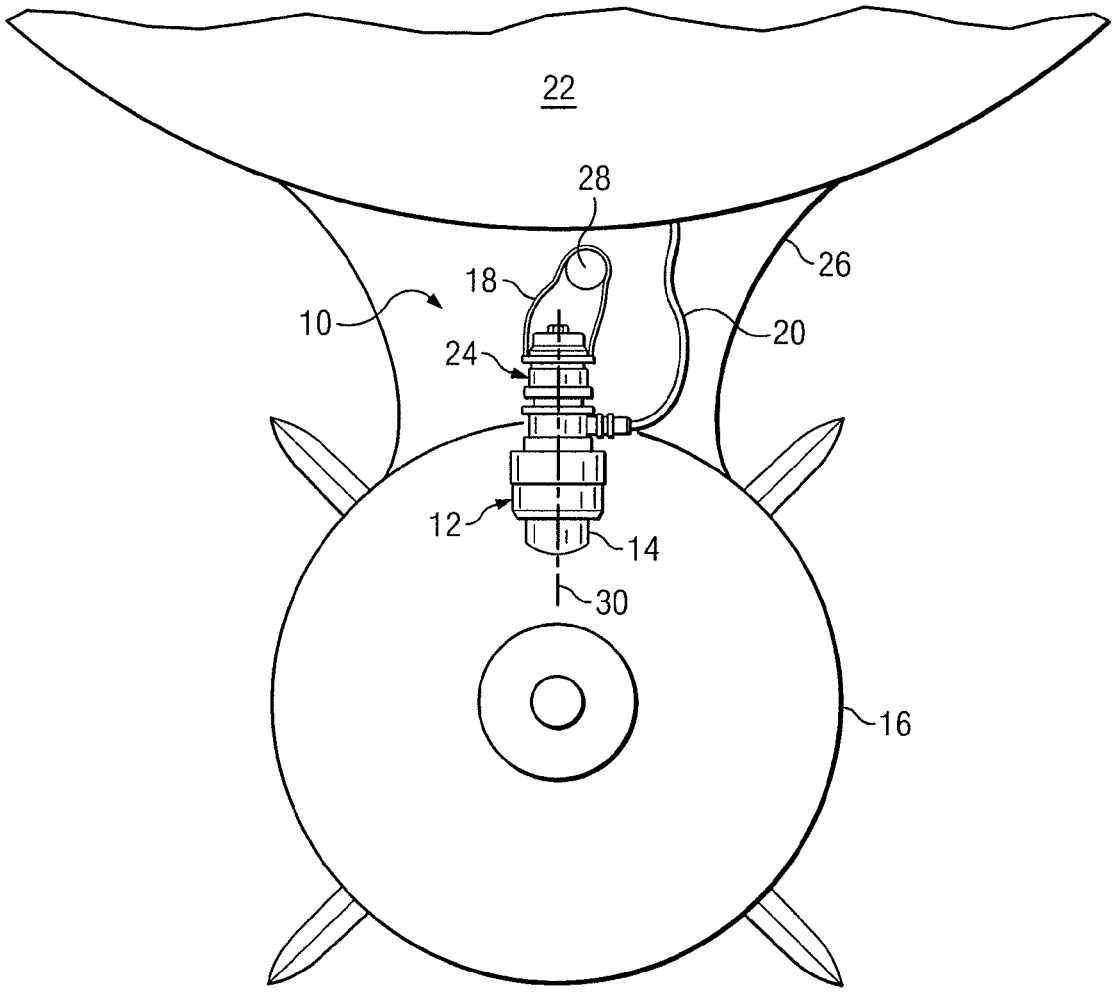
FIG. 1 illustrates an example connection system according to certain embodiments of the present disclosure.

FIG. 1 illustrates an example connection system 8 according to certain embodiments of the present disclosure. Connection system 8 includes connector assembly 10 that is adapted to electrically couple a payload 16 to a vehicle, which in this particular embodiment, is an aircraft 22. Connector assembly 10 includes a lanyard release connector 12 that is adapted to be mated to a complementary connector 14 of payload 16, and released from complementary connector 14 due to a pulling action on a lanyard 18 relative to lanyard release connector 12. Lanyard release connector 12 is electrically coupled to an umbilical cable 20 that conveys electrical signals from one or more systems configured on aircraft 22. As will be described in detail below, connection system 8 includes a secondary latching release mechanism 24 that actuates lanyard release connector 12 when lanyard 18 actuates secondary latching release mechanism 24.

Aircraft 22 includes a pod 26 for physically mounting payload 16 to aircraft 22. Pod 26 includes a bailbar 28 over which lanyard 18 may be engaged. Thus, when payload 16 is ejected from aircraft 22, movement of payload 16 away from aircraft 22 causes lanyard 18 to exert a pulling action on connection system 8 that releases lanyard release connector 12 from payload 16. Bailbar 28 generally includes a rigid rod-like structure that is rigidly fixed in pod 26. In some cases, bailbar 28 may be configured at an offset position from a central axis 30 of lanyard release connector 12. Thus, lanyard may exert a force with a lateral component upon lanyard release connector 12 such that lanyard release connector 12 and/or the complementary connector configured on payload 16 may be potentially damaged during release.

The particular embodiment describes a connection system 8 used with an aircraft 22. In certain embodiments, connection system 8 may be used with any suitable type of vehicle, such as, for example, a tank, an armored personnel vehicle, a truck, or a boat. Aircraft 22 includes any type that may be configured with releasable payloads 16. Aircraft 22 may be a military aircraft that delivers payload 16 to and ejects payload over an intended target. In certain embodiments, aircraft 22 may be a military aircraft, such as a fighter jet that delivers multiple payloads 16 to one or more intended targets. In this case, the fighter jet may be configured with a connection system 8 for each payload 16 that it carries.

Payloads 16, such as smart bombs or missiles provide several advantages over conventional weapons, such as gravity bombs, that may be dropped from aircraft 22. One advantage is that smart bombs may provide increased accuracy using onboard guidance systems that direct its movement during its fall towards its intended target. For proper operation, these guidance systems and other processing systems configured on payloads 16 are electrically coupled to processing systems configured on aircraft 22 using umbilical cable 20. When payload 16 is ejected by aircraft 22, lanyard release connector 12 is separated from its complementary connector configured on payload 16. In many conventional systems, however, the lanyard release connector may not separate cleanly or become jammed during separation from its complementary connector.

Payload 16 may be any type that includes one or more systems that may be electrically coupled to aircraft 22 using a complementary connector that may be mated to, and released from lanyard release connector 12 when jettisoned. For example, payload 16 may include a bomb that falls at a trajectory determined by the path of aircraft, or a missile that provides its own motive force once ejected from aircraft 22. In certain embodiments, payload 16 may include any type including a cache of munitions, a cache of supplies, a missile, or a bomb.

Figure 2:
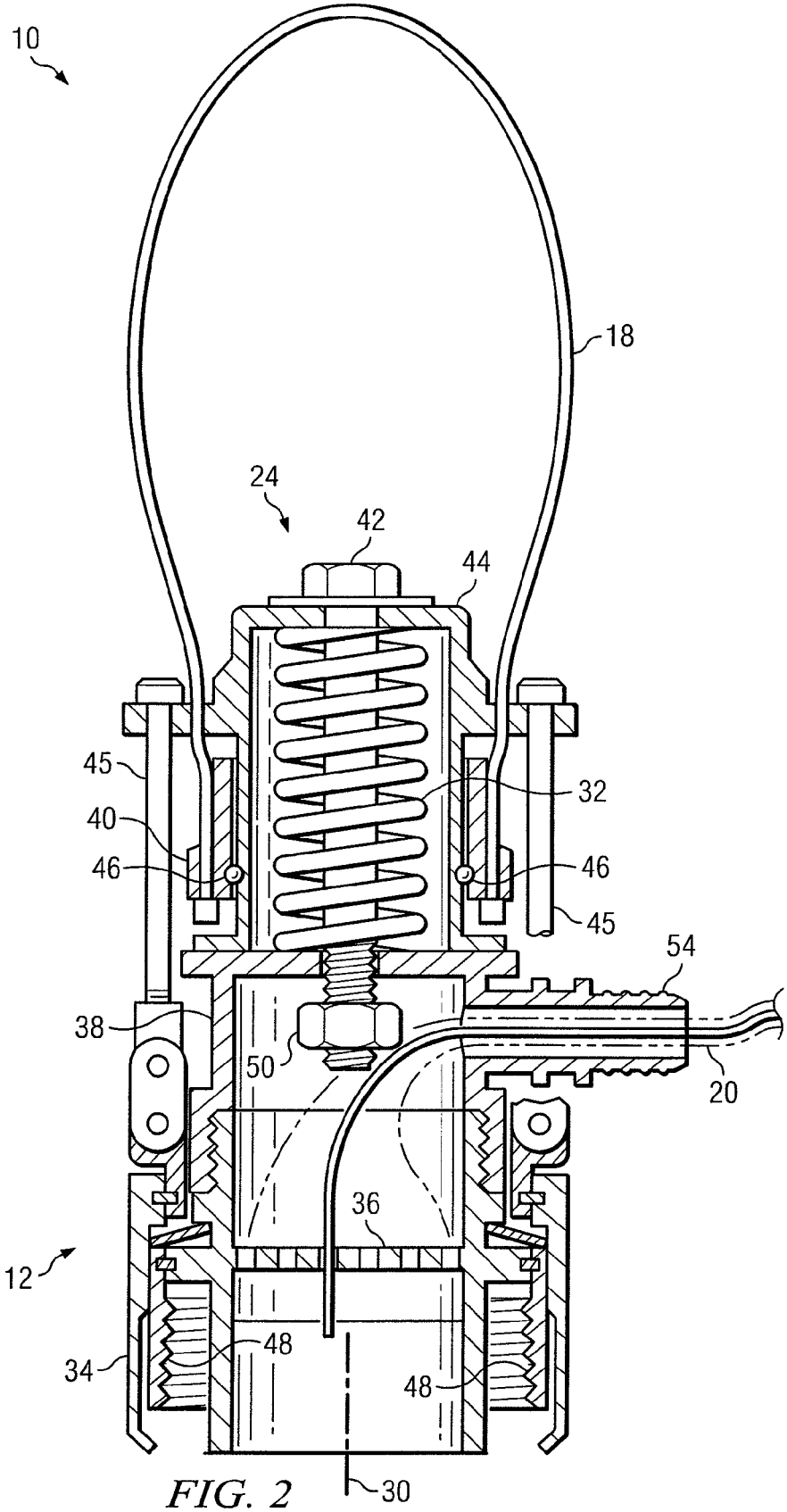
FIGS. 2 and 3 illustrate an example connection system of FIG. 1.
Figure 3:
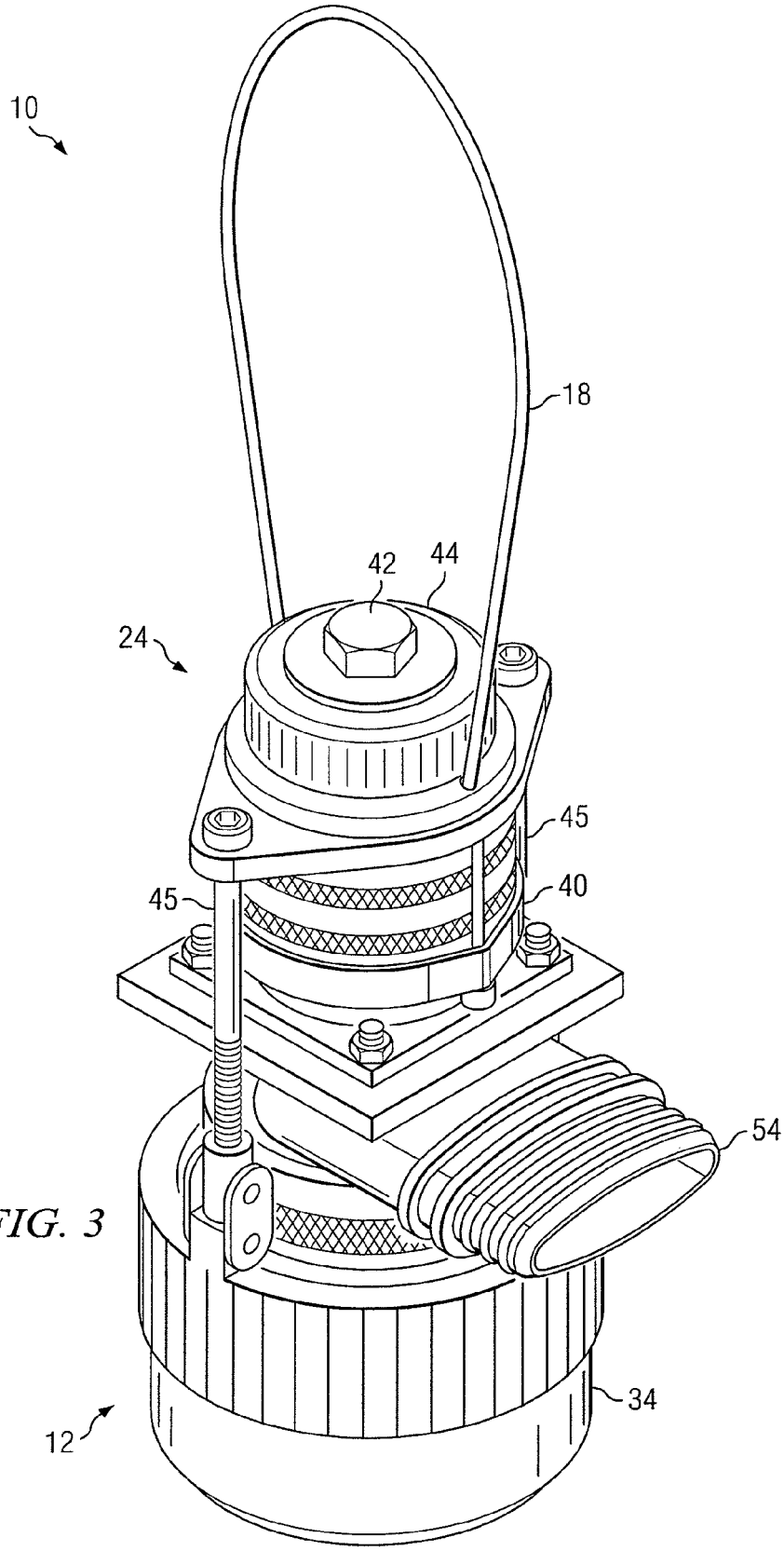

FIGS. 2 and 3 illustrate an example connector assembly 10 of the example connection system 8 of FIG. 1. Connector assembly 10 includes lanyard release connector 12 having a primary latching release mechanism 34 and a contact housing 36 with one or more electrical contacts. Connector assembly 10 also includes a backshell 38 that functions as a shroud for umbilical cable 20, and a secondary latching release mechanism 24 that actuates the primary latching release mechanism 34 of lanyard release connector 12.

Certain embodiments of the present disclosure may provide one or more technical advantages. For example, certain embodiments of connector assembly 10 may provide improved separation of lanyard release connector 12 from its complementary connector 14 during ejection of payloads 16 from which it may be connected. The timing of the ejection of payloads 16, such as smart bombs may be important to the accuracy of their trajectory during descent. Known implementations of lanyard release connectors, however, may bind during release of the primary latching release mechanism 34 such that the payload does not eject properly from aircraft 22. The secondary latching release mechanism 24 provides an additional mechanical force to ensure that lanyard release connector 12 is released in a timely and consistent manner.

Conventional implementations of the lanyard release connector typically incorporate a lanyard that is directly coupled to its latching release mechanism such that actuation of the lanyard release connector is at least mostly provided by a pulling action of its associated lanyard during ejection of a payload 16. Many pod designs, however, provide a bailbar 28 whose placement is not aligned over the axis 30 of the lanyard release connector when coupled to its complementary connector of the payload 16. Thus, when the payload 16 is ejected, lateral component forces may be exerted upon the lanyard release connector that may potentially damage its connector housing due to binding during de-coupling from its complementary connector. Certain embodiments of the secondary latching release mechanism 24 direct a force upon axis 30 of lanyard release connector 12 in a relatively even manner to ensure that lanyard release connector 12 does not bind with its complementary connector 14 during separation.

Secondary latching release mechanism 24 includes a mechanical forcing device that applies a releasing force to lanyard release connector 12 upon actuation by a pulling action by lanyard 18. In certain embodiments, secondary latching release mechanism 24 may include a compression spring 32, a latch 40, a lanyard 18, a bolt 42, and a housing 44 that houses bolt 42 and compression spring 32 and is coupled to backshell 38 as shown. Secondary latching release mechanism 24 may alternatively move from a loaded position to a released position. Secondary latching release mechanism 24 is the loaded position when latch 40 is engaged and spring 32 is in a compressed position such that coupling rods 45 allow primary latching release mechanism 34 to remain engaged with its complementary connector 14. Secondary latching release mechanism 24 is the released position when latch 40 is released by pulling on lanyard 18 such that spring exerts a mechanical force sufficient to release primary latching release mechanism 34 of lanyard release connector 12 through coupling rods 45.

In the particular embodiment shown, latch 40 is a ball bearing latch that uses multiple ball bearings 46 configured around backshell 38 for holding latch 40 in the loaded position. In certain embodiments, any suitable type of latch design may be used that may be actuated by pulling force placed on lanyard away from connector assembly 10.

Figure 4:
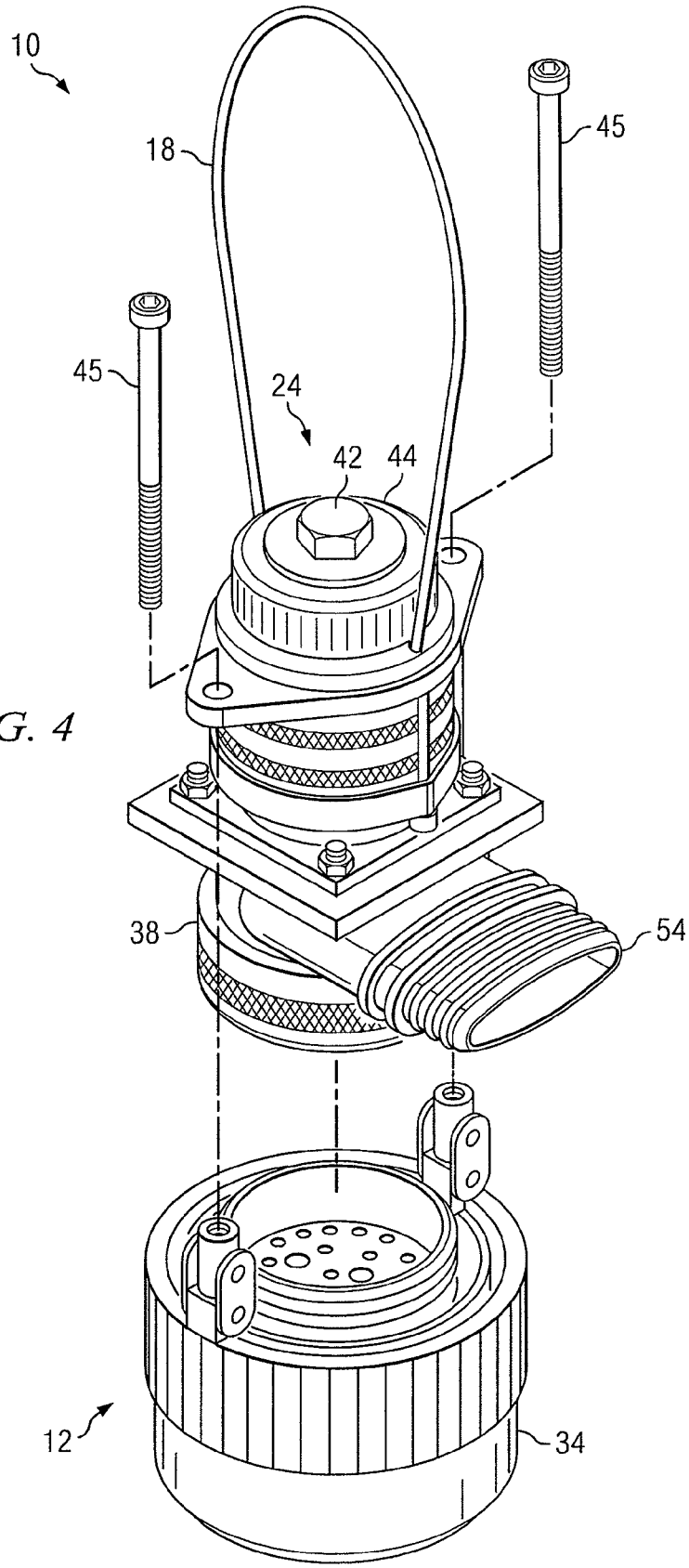
FIG. 4 illustrates the example connector assembly of FIGS. 2 and 3 in which a lanyard release connector is removed from a backshell.

FIG. 4 illustrates the example connector assembly 10 of FIGS. 2 and 3 in which a lanyard release connector 12 is removed from a backshell 38. Lanyard release connector 12 may be removed from backshell 38 by removing coupling rods 45 from backshell 38. In certain embodiments, lanyard release connector 12 is a type of connector conforming to a military standard 1760 (MIL-STD-1760) specification, such as a connector having a D38999/31 series part number. Primary latching release mechanism 34 includes internal threads 48 such that the complementary connector may be screwingly inserted into lanyard release connector 12. Threads 48 are provided in multiple sections such that when latching release mechanism is actuated, threads 48 separate from one another away from axis 30 to allow separation of complementary connector 14.

Coupling rods 45 mechanically couple housing 44 to primary latching release mechanism 34 for transferring a mechanical force from spring necessary for releasing primary latching release mechanism 34. In certain embodiments, multiple coupling rods 45 may be evenly spaced around a central axis 30 of contact housing 36. In this manner, the force provided by compression spring 32 may be directed in a relatively even manner around primary latching release mechanism 34 of lanyard release connector 12 to ensure that contact housing 36 does not bind with its complementary connector 14 during separation.

Figure 5:
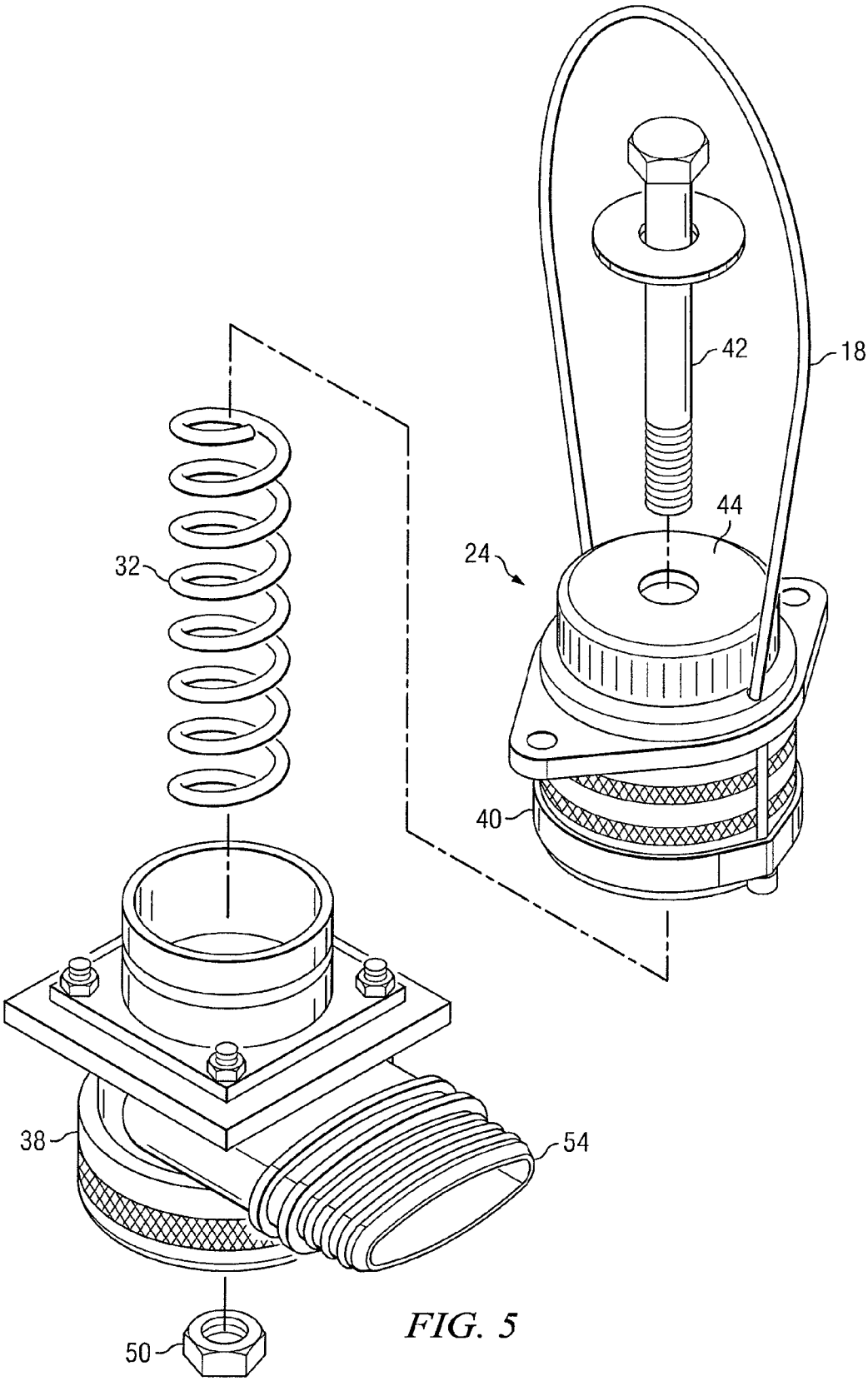
FIG. 5 illustrates the example connector assembly of FIGS. 2 and 3 in which a bolt is removed in order to reveal a compression spring of a secondary latching release mechanism.

FIG. 5 illustrates the example connector assembly 10 of FIGS. 2 and 3 in which a bolt 42 is removed in order to reveal a compression spring 32 of a secondary latching release mechanism 24. Bolt 42 limits the extension of compression spring 32. Thus when fully extended, compression spring 32 may be maintained in an at least slightly compressed state by tension provided through bolt 42. In other embodiments, any suitable mechanism for maintaining compression spring 32 in a compressed state when fully extended may be used.

Compression spring 32 comprises one embodiment of a mechanical forcing device that may be used to exert a mechanical force for releasing primary latching release mechanism 34 from the complementary connector 14 of payload 16. In certain embodiments, any device that develops a mechanical force sufficient for disengaging primary latching release mechanism 34 may be used. For example, secondary latching release mechanism 24 may include other types of spring devices, such as tension spring that provides a pulling force or a torsion spring that provides a torsional force for disengaging primary latching release mechanism 34. As another example, secondary latching release mechanism 24 may include one or more Belleville springs that provide a compressive force for disengaging primary latching release mechanism 34. As another example, secondary latching release mechanism 24 may include an a mechanical forcing device that develops a mechanical force in response energy provided from an external power source, such as a solenoid or an elongated section of muscle wire that physically contracts under the influence of an electrical current.

In certain embodiments, backshell 38 is a 90 degree backshell in which its outlet port 54 is oriented at 90 degrees relative to the axis 30 of contact housing 36. The 90 degree backshell provides egress for umbilical cable 20 without interfering with the operation of secondary latching release mechanism 24. In certain embodiments, a straight backshell may be provided in which umbilical cable 20 is routed through the inner region of spring 32 with the substitution of an alternate mechanical movement limiting mechanism for the illustrated bolt 42. The outlet port 54 may be any suitable shape, such as an oval shape as shown, a rectangular shape, or a round shape.

In an alternative embodiment, a tension spring functioning as mechanical forcing device may be configured perpendicular to the 30 axis of latching release connector 12 such that a straight backshell may be implemented with connector assembly 10. In this case, the tension spring may be coupled to primary latching release mechanism 34 through a cable that rides upon a pulley for developing a mechanical force that may be applied to releasing latching release connector 12 generally along its axis 30. In this manner, a backshell 38 may be implemented with a outlet port for routing umbilical cable in a manner that does not interfere with the operation of secondary latching release mechanism 24.

In another alternative embodiment, outlet port 54 and compression spring 32 may be oriented co-axially to each other and approximately perpendicular to axis 30 of lanyard release connector 12. In this configuration, the compression spring may be coupled to lanyard release connector 12 using a cable and pulley arrangement as described above such that the compression spring transfers its force to lanyard release connector 12 at a perpendicular angle. In this particular embodiment, umbilical cable 20 may be routed through compression spring 32 in lieu of bolt 42. Any suitable mechanical movement limiting device may be implemented to limit the travel of the compression spring when fully extended.

Modifications, additions, or omissions may be made to connector assembly 10 without departing from the scope of the disclosure. The components of connector assembly 10 may be integrated or separated. For example, latch 40 may be coupled to housing 44 or may be integrally formed with housing 44. Moreover, the operations of connector assembly 10 may be performed by more, fewer, or other components. For example, secondary latching release mechanism 24 may include or components, such as additional springs for manipulating its action during actuation of directing forces placed upon primary latching release mechanism 34 of lanyard release connector 12. As used in this document, "each" refers to each member of a set or subset of a set.

Figure 6:
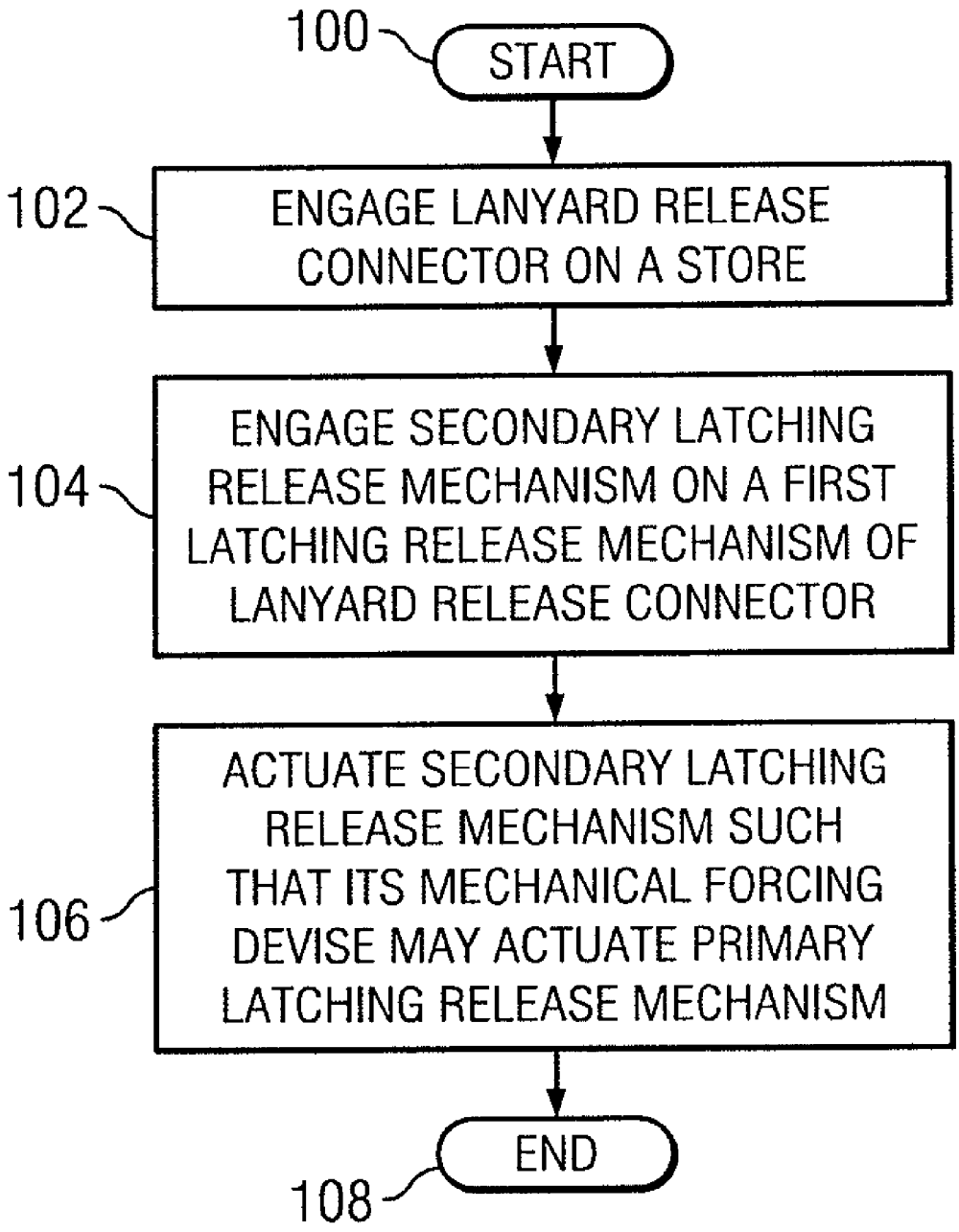
FIG. 6 illustrates an example method that may be performed by the example connector assembly of FIGS. 2 and 3.

FIG. 6 illustrates an example method that may be performed by the example connector assembly 10 of FIGS. 2 and 3. In act 100, the process is initiated.

In act 102, lanyard release connector 12 is engaged on a connector of a payload 16, such as a bomb or a missile. Lanyard release connectors 12 of this type are typically configured on military vehicles such as aircraft 22 to provide electrical connectivity with the payload, and quickly release or decouple from the payload's connector when jettisoned. For example, payload 16 may include one or more guidance systems that are programmed with guidance information about its target shortly before being jettisoned from its associated aircraft 22. Electrical connections provided by lanyard release connector 12 may therefore, provide communication between payload 16 and its associated aircraft 22 while allowing relatively quick disconnection when payload 16 is jettisoned from aircraft. In certain embodiments, lanyard release connector 12 may be engaged on the connector of payload 16 using a latch 40 that selectively maintains connector housing 44 of lanyard release connector 12 on the connector of payload 16.

In act 104, secondary latching release mechanism 24 may be engaged on primary latching release mechanism 34 of lanyard release connector 12. Secondary latching release mechanism 24 may be engaged on primary latching release mechanism 34 in any suitable manner. In certain embodiments, primary latching release mechanism 34 may be engaged by loading a forcing device, such as a spring 32, and holding spring 32 in its loaded position using latch 40. In certain embodiments, secondary latching release mechanism 24 may include an externally powered forcing device, such as an elongated section of muscle wire having terminals that are engaged on complementary terminals configured on aircraft 22 for providing electrical power for actuating secondary latching release mechanism 24.

In act 106, secondary latching release mechanism 24 may be actuated such that the forcing device may actuate primary latching release mechanism 34 to release the connector of its associated payload 16 from aircraft 22. The forcing device may be configured on primary latching release mechanism 34 such that it provides a releasing force that is substantially co-axial with the axis of connector housing 44 of lanyard release connector 12. In this manner, the connector housing 44 may be decoupled linearly away from the connector of the payload in spite of the direction of the force used to actuate the secondary latching release mechanism 24. Thus, connector assembly 10 may be used in environments in which an anchor point formed by bailbar 28 that is generally co-axial with the connector housing 44 is relatively difficult to achieve.

In act 108, connector assembly 10 has been decoupled from its complementary connector in which the process ends.

Certain embodiments of the present disclosure may provide one or more technical advantages. For example, certain embodiments of the connection system 8 may provide improved separation of lanyard release connector 18 from its complementary connector 14 during ejection of a payload 16 to which it may be connected. The timing of the ejection of payloads 16 may be important to the accuracy of their trajectory during descent. Thus, the secondary latching release mechanism 24 of certain embodiments of the present disclosure may provide an additional mechanical force to help ensure that lanyard release connector 12 is released in a timely and consistent manner. For example, the additional mechanical force provided by certain embodiments of the present disclosure may help overcome problems introduced by binding between the lanyard release connector 12 and its complementary connector 14 that may occur during release of lanyard release connector 12, which may help ensure that payload 16 ejects properly from an aircraft 22 or other entity.

In a particular example, certain embodiments of the secondary latching release mechanism direct a force upon lanyard release connector 12 in a relatively even manner along the axis 30 of lanyard release connector 12 to ensure that lanyard release connector 12 does not bind with its complementary connector 14 during separation.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A connection system comprising:

a lanyard release connector adapted for use with a vehicle and having a primary latching release mechanism adapted to hold a complementary connector of a payload and release the complementary connector when actuated such that the payload may be jettisoned from the vehicle; and a secondary latching release mechanism adapted to couple the lanyard release connector to a lanyard, the secondary latching release mechanism comprising:

a spring; and a latch adapted to hold the spring in a compressed position and release the spring when the latch is actuated by the lanyard, the spring configured to generate a force for actuating the lanyard release connector in which the force is co-axial with an axis of a connector housing of the lanyard release connector in which the force is co-axial with an axis of a connector housing of the lanyard release connector.

2. A connection system comprising:

a lanyard release connector having a primary latching release mechanism adapted to hold a complementary connector of a payload and release the complementary connector when actuated such that the payload may be jettisoned from a vehicle; and a secondary latching release mechanism coupling the lanyard release connector to a lanyard, the secondary latching release mechanism comprising a mechanical forcing device that is operable to apply a force that actuates the primary latching release mechanism when the mechanical forcing device is actuated by the lanyard.

3. The connection system of claim 2, wherein the forcing device is adapted to generate the force co-axially with an axis of a connector housing of the lanyard release connector.

4. The connection system of claim 2, wherein the secondary latching release mechanism comprises:

a spring; and a latch adapted to hold the spring in a loaded position and release the spring when actuated by the lanyard.

5. The connection system of claim 4, further comprising a cable having a first end coupled to the mechanical forcing device and a second end coupled to the connector housing, the cable extending over a pulley such that the cable transfers a tension force from the mechanical forcing device to the connector housing in which the axis of the connector housing is not co-axial with the mechanical forcing device.

6. The connection system of claim 2, wherein the mechanical forcing device comprises an electro-mechanical device adapted to generate the force in response to excitation of the electro-mechanical device with an electrical current.

7. The connection system of claim 6, wherein the electro-mechanical device comprises an elongated section of muscle wire.

8. The connection system of claim 2, wherein the vehicle comprises a military aircraft and the payload comprises one or more of the following:

a cache of munitions;

a cache of supplies;

a missile; and a bomb.

9. The connection system of claim 2, further comprising a lanyard coupled to the secondary latching release mechanism and adapted to be engaged over a bail bar of the vehicle, the lanyard release connector complying with a military standard 1760 (MIL-STD-1760) specification.

10. The connection system of claim 2, wherein the lanyard release connector comprises a 90 degree backshell.

11. The connection system of claim 10, wherein the 90 degree backshell has an oval-shaped port.

12. A connector coupling method comprising:

engaging a lanyard release connector on a complementary connector of a payload, the lanyard release connector adapted for use in a vehicle and having a primary latching release mechanism that holds the lanyard release connector on the complementary connector;

engaging a secondary latching release mechanism on the primary latching release mechanism, the secondary latching release mechanism comprising a mechanical forcing device that is coupled to the primary latching release mechanism, the mechanical forcing device adapted to be actuated by a lanyard such that the mechanical forcing device applies a force upon the primary latching release mechanism to release the lanyard release connector from the complementary connector of the payload.

13. The connector coupling method of claim 12, further comprising:

generating, by the mechanical forcing device, the force co-axially with an axis of a connector housing of the lanyard release connector.

14. The connector coupling method of claim 12, further comprising:

holding a spring in a loaded position using a latch, the spring comprising the mechanical forcing device; and releasing the spring when the latch is actuated.

15. The connector coupling method of claim 14, further comprising:

transferring a tension force from the mechanical forcing device to the lanyard release connector using a cable having a first end coupled to the mechanical forcing device and a second end coupled to the lanyard release connector, the cable extending over a pulley such that the axis of the connector housing is not co-axial with the mechanical forcing device.

16. The connector coupling method of claim 12, further comprising:

generating the force using an electro-mechanical device by exciting the electro-mechanical device with an electrical current, the electro-mechanical device comprising the mechanical forcing device.

17. The connector coupling method of claim 16, wherein the electro-mechanical device comprises an elongated section of muscle wire.

18. The connector coupling method of claim 12, wherein the aircraft comprises an aircraft and the payload comprises one or more of the following:

a cache of munitions;

a cache of supplies;

a missile; and a bomb.

19. The connector coupling method of claim 12, further comprising:

engaging the lanyard over a bailbar of the aircraft, the lanyard release connector complying with a military standard 1760 (MIL-STD-1760) specification.

20. The connector coupling method of claim 12, wherein the lanyard release connector comprises a 90 degree backshell.

* * * * *